US006341737B1

(12) United States Patent
Chang

(10) Patent No.: US 6,341,737 B1
(45) Date of Patent: Jan. 29, 2002

(54) PISTOL NOZZLE

(76) Inventor: Jung-Hsien Chang, 7F-2, No. 5, Fuan 7th St., Fuan Li, Shi-Tun Chu, Taichung (TW)

( * ) Notice: Subject to any disclaimer, the term of this patent is extended or adjusted under 35 U.S.C. 154(b) by 41 days.

(21) Appl. No.: 09/602,582

(22) Filed: Jun. 21, 2000

(51) Int. Cl.[7] ..... A62C 31/02

(52) U.S. Cl. ..... 239/394; 239/526; 239/558; 239/437

(58) Field of Search ..... 239/390, 391, 239/392, 393, 394, 395, 396, 548, 550, 553, 553.3, 554, 555, 562, 556, 558, 560, 437

(56) References Cited

U.S. PATENT DOCUMENTS 5,598,978 A * 2/1997 Wang ..... 239/394
6,164,566 A * 12/2000 Hui-Chen ..... 239/394
6,230,988 B1 * 5/2001 Chao ..... 239/394
6,286,767 B1 * 9/2001 Hui-Chen ..... 239/394

* cited by examiner

*Primary Examiner*—David A. Scherbel
*Assistant Examiner*—Dinh Q. Nguyen
(74) *Attorney, Agent, or Firm*—W. Wayne Liauh

(57) ABSTRACT

A water nozzle which includes a rotary cover, a water distribution disk, a water discharging disk, and a water admission head. The rotary cover is provided with a plurality of water emission holes of varying shapes. The water emission holes are provided with a hollow water discharging pillar, a notch located at the front end of the discharging pillars, a rib wall located between two separated water discharging pillars. The water distribution disk is provided with a large water distribution hole, a small water distribution hole, and a plurality of intermediate water distribution holes corresponding to the water emission holes, and a water slot concentric with the large water distribution hole. The water discharging disk is provided with a large water discharging hole, an intermediate water discharging hole, and a small water discharging hole, which are concentric with the large water distribution hole, the intermediate water distribution holes, and the small water distribution hole and are provided with a hollow protrusion. The cooperation between the concentric holes of the water distribution disk and the water discharging disk allows water to be emitted in varying patterns.

3 Claims, 9 Drawing Sheets

PISTOL NOZZLE

FIELD OF THE INVENTION

The present invention relates generally to a water sprinkling device, and more particularly to a pistol nozzle.

BACKGROUND OF THE INVENTION

As shown in FIG. 1, a prior art pistol nozzle 01 is provided at the front end with a water inlet 02, which is joined by a nozzle cover 03. Located between the water inlet 02 and the nozzle cover 03 is a water emission piece 05 which is provided with a plurality of water emission holes 06. The nozzle cover 03 is provided with a water outlet 06 from which the water is emitted.

Such a prior art pistol nozzle as described above is defective in design in that the water can not be emitted in various fashions, and that the flow of water is not stable, and further that it is not provided with a leakproof means to prevent the water leak.

SUMMARY OF THE INVENTION

The primary objective of the present invention is to provide pistol nozzle which is free from the drawbacks of the prior art pistol nozzle described above.

The features and the advantages of the present invention will be readily understood upon a thoughtful deliberation of the following detailed description of a preferred embodiment of the present invention with reference to the accompanying drawings.

DETAILED DESCRIPTION OF THE INVENTION

Figure 1:
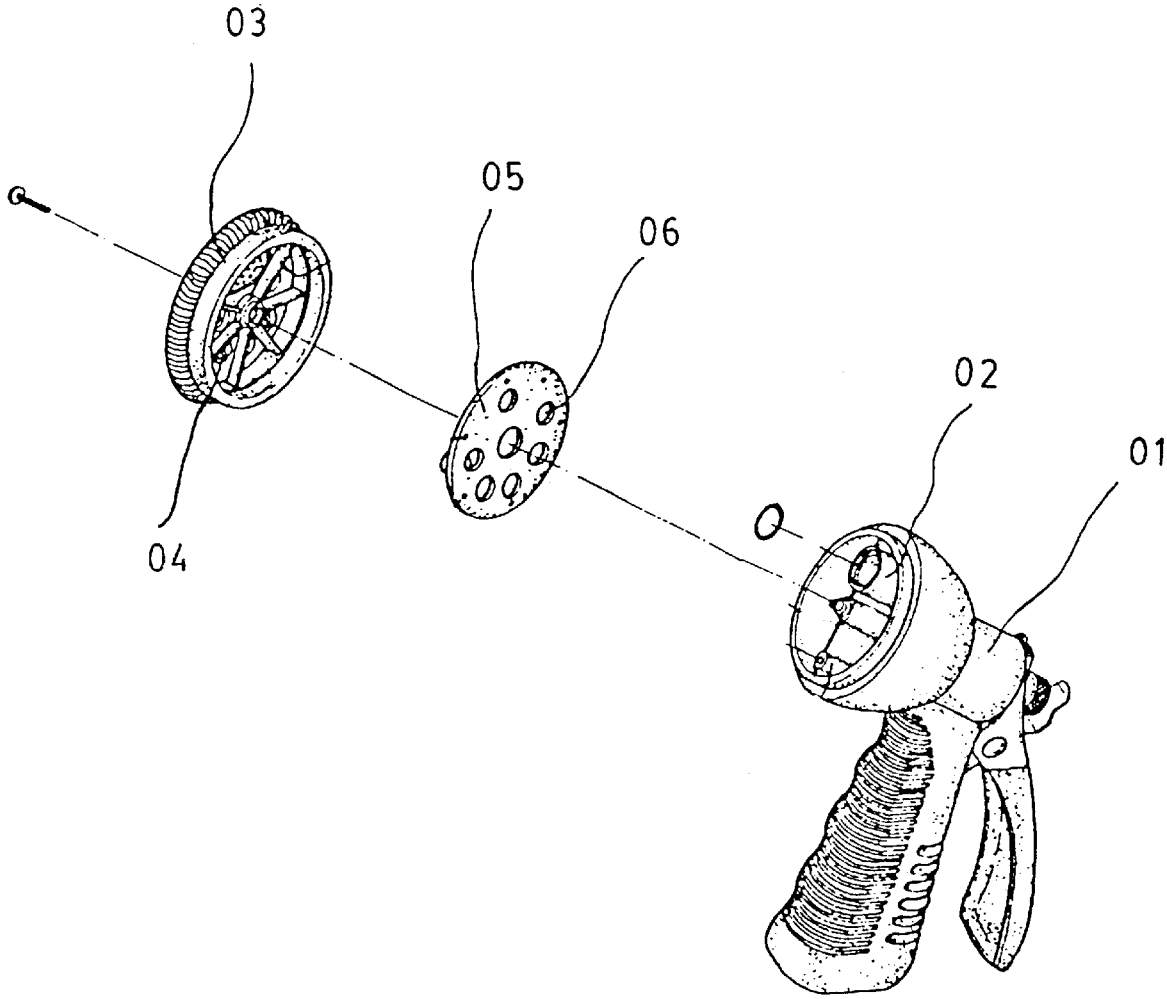
FIG. 1 shows an exploded view of a pistol nozzle of the prior art.
Figure 2:
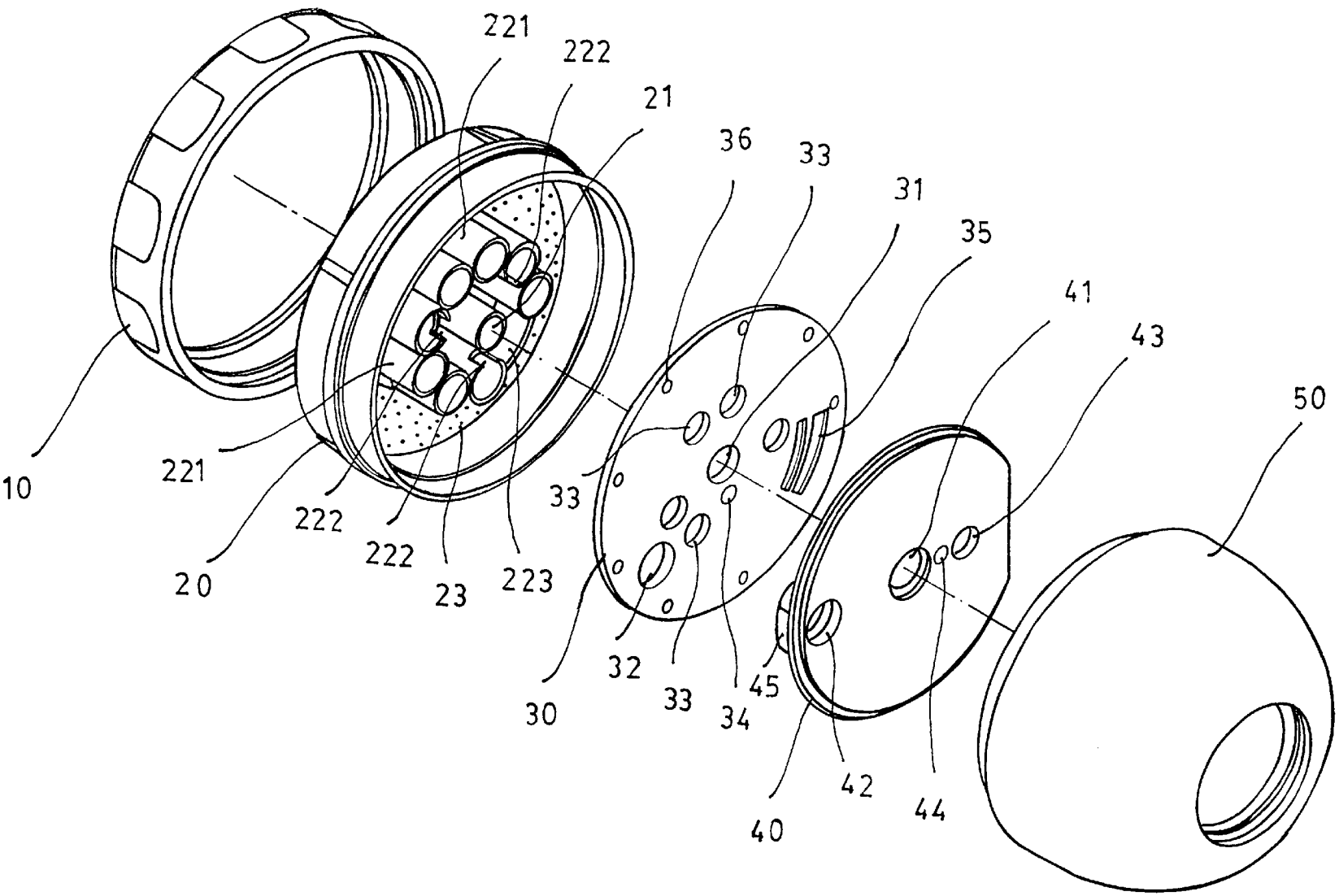
FIG. 2 shows an exploded view of a pistol nozzle of the present invention.
Figure 3:
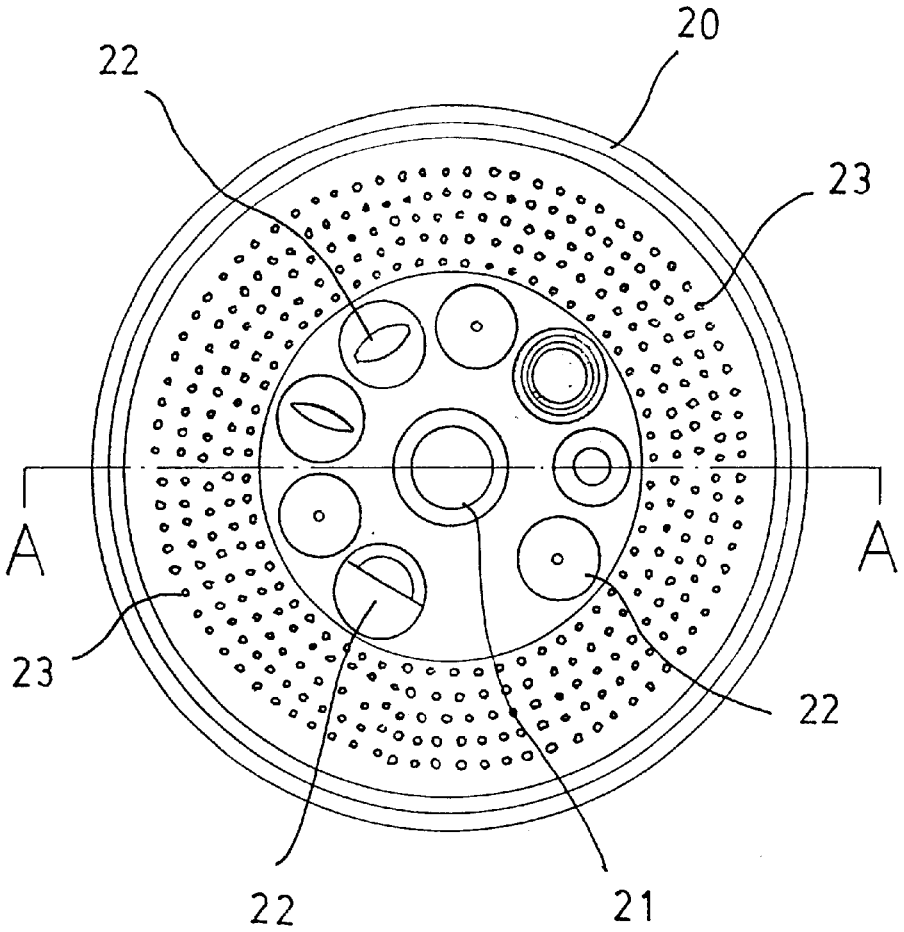
FIG. 3 shows a front view of a rotary cover of the present invention.
Figure 4:
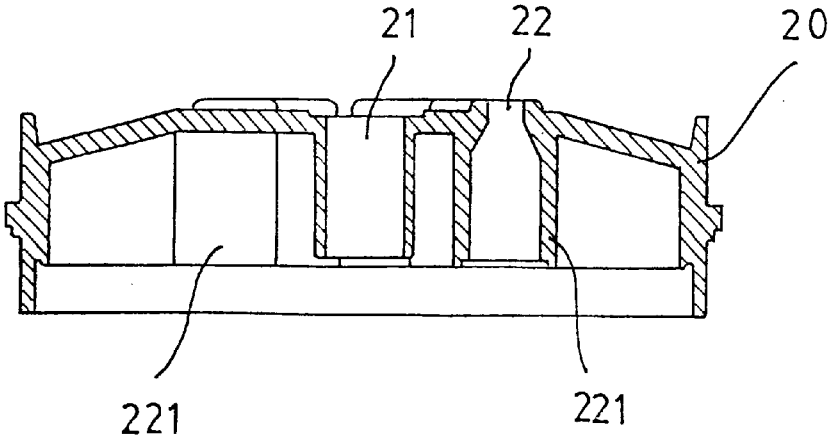
FIG. 4 shows a sectional view taken along the direction indicated by a line A—A as shown in FIG. 3.
Figure 5:
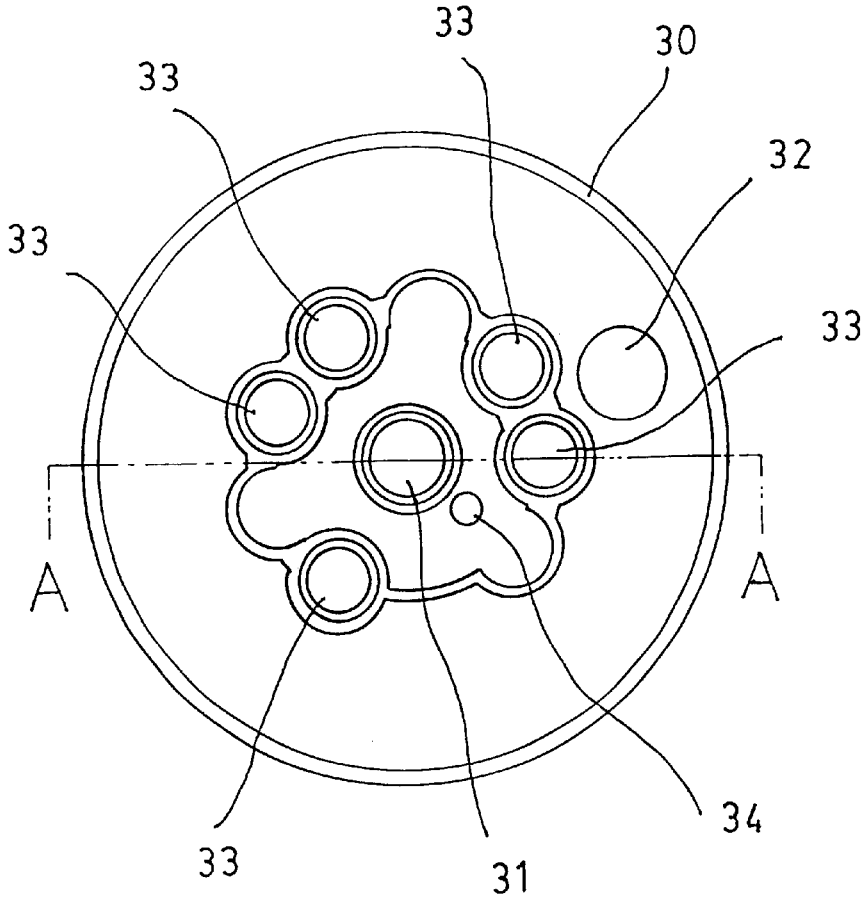
FIG. 5 shows a front plan view of a water distribution disk of the present invention.

As shown in FIGS. 2–8, a pistol nozzle embodied in the present invention is formed of a protective cover 10, a multi-stepped rotary cover 20, a water distribution disk 30,a water discharging disk 40, and a water admission head 50.

The protective cover 10 is joined with the rotary cover 20 such that the rotary cover 20 is actuated by the protective cover 10 to turn in a multi-stepped fashion.

The rotary cover 20 is provided in the center with an axial hole 21 and is further provided with a plurality of water emission holes 22 and meshes 23.

The water distribution disk 30 is provided with a center hole 31 and a plurality of locating slots which are equidistantly arranged along the peripheral edge of the water distribution disk 30.

The water discharging disk 40 is provided with a center hole 41.

The water admission head 50 is provided in the center with a shaft rod 51 which is provided with a water distribution duct 52. The head 50 is fastened with the barrel of a pistol nozzle.

Figure 6:
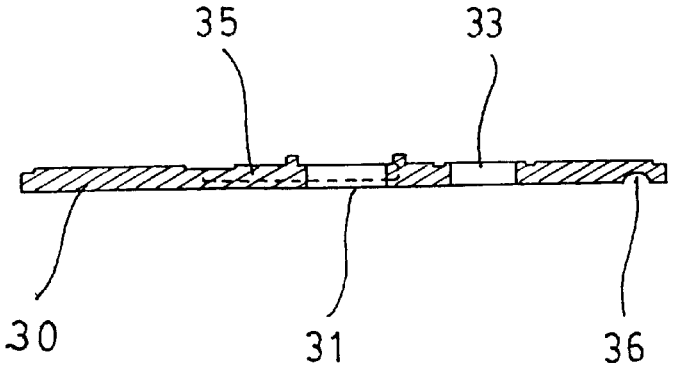
FIG. 6 shows a sectional view taken along the direction indicated by a line A—A as shown in FIG. 5.
Figure 7:
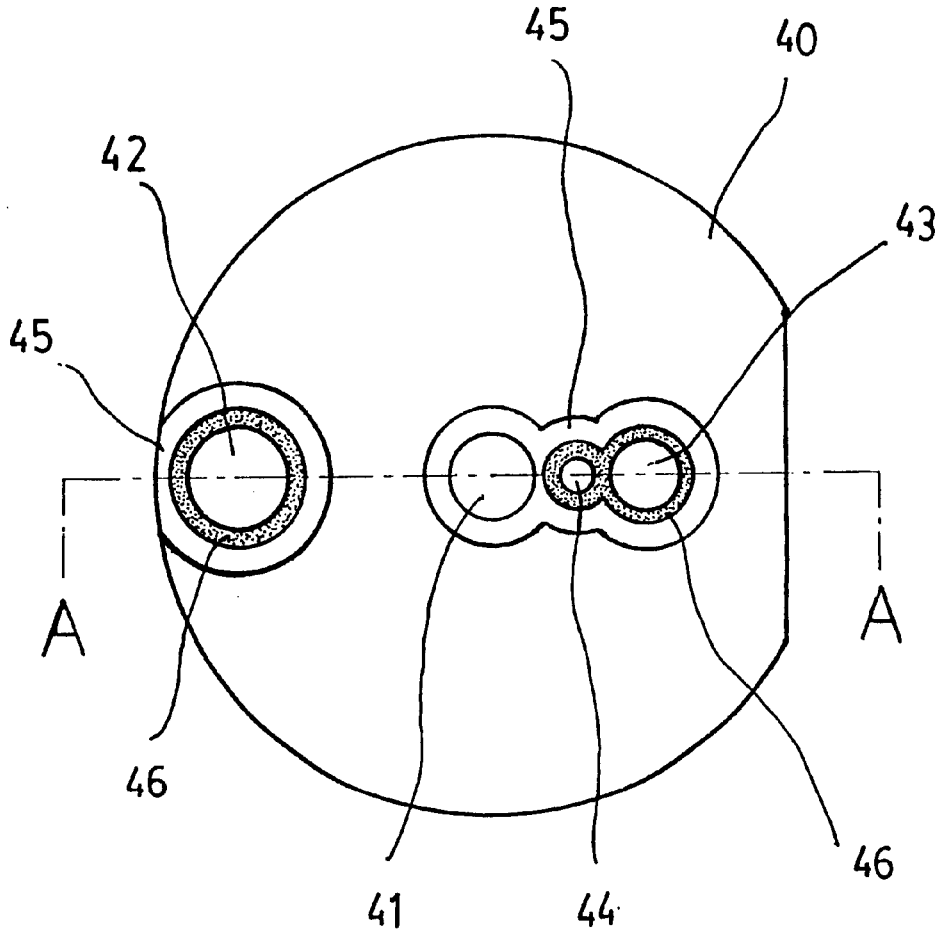
FIG. 7 shows a front plan view of a water emission disk of the present invention.
Figure 8:
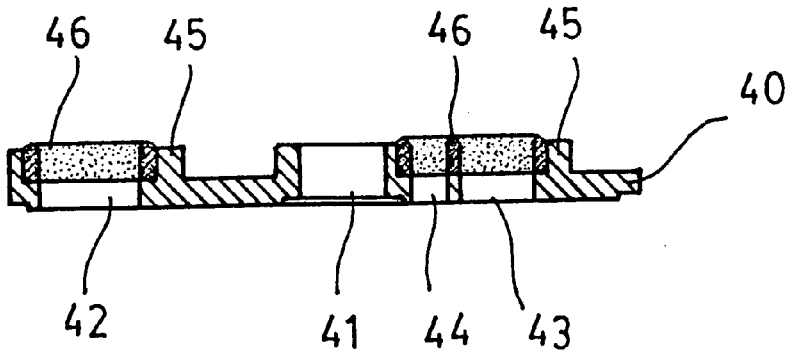
FIG. 8 shows a sectional view taken along the direction indicated by a line A—A as shown in FIG. 7.

The present invention is characterized by the rotary cover 20, which is provided in the water emission holes 22 with a hollow water emission pillar 221, a notch 222 disposed at the front end of three water emission pillars 221 which are not adjacent to one another, and a rib wall 223 disposed between two water emission pillars 221 such that the rib wall 223 and the water emission pillars 221 form together a closed space. In addition, the water distribution disk 30 is provided with a large water distribution hole 32, a small water distribution hole 34, and a plurality of intermediate water distribution holes 33 corresponding in location to the water emission holes 22 of the rotary cover 20. The water distribution disk 30 is further provided with a water slot 35 which is concentric with the large water distribution hole 32, as shown in FIG. 6. The water discharging disk 40 is provided with a large water discharging hole 42, an intermediate water discharging hole 43,and a small water discharging hole 44, which are respectively concentric with the large water distribution hole 32, the intermediate water distribution hole 33, and the small water distribution hole 34 of the water distribution disk 30. The center hole 41, the large water discharging hole 42, the intermediate water discharging hole 43, and the small water discharging hole 44 are respectively provided with a hollow protrusion 45 which circumvents the respective hole, as shown in FIG. 8.

Figure 9:
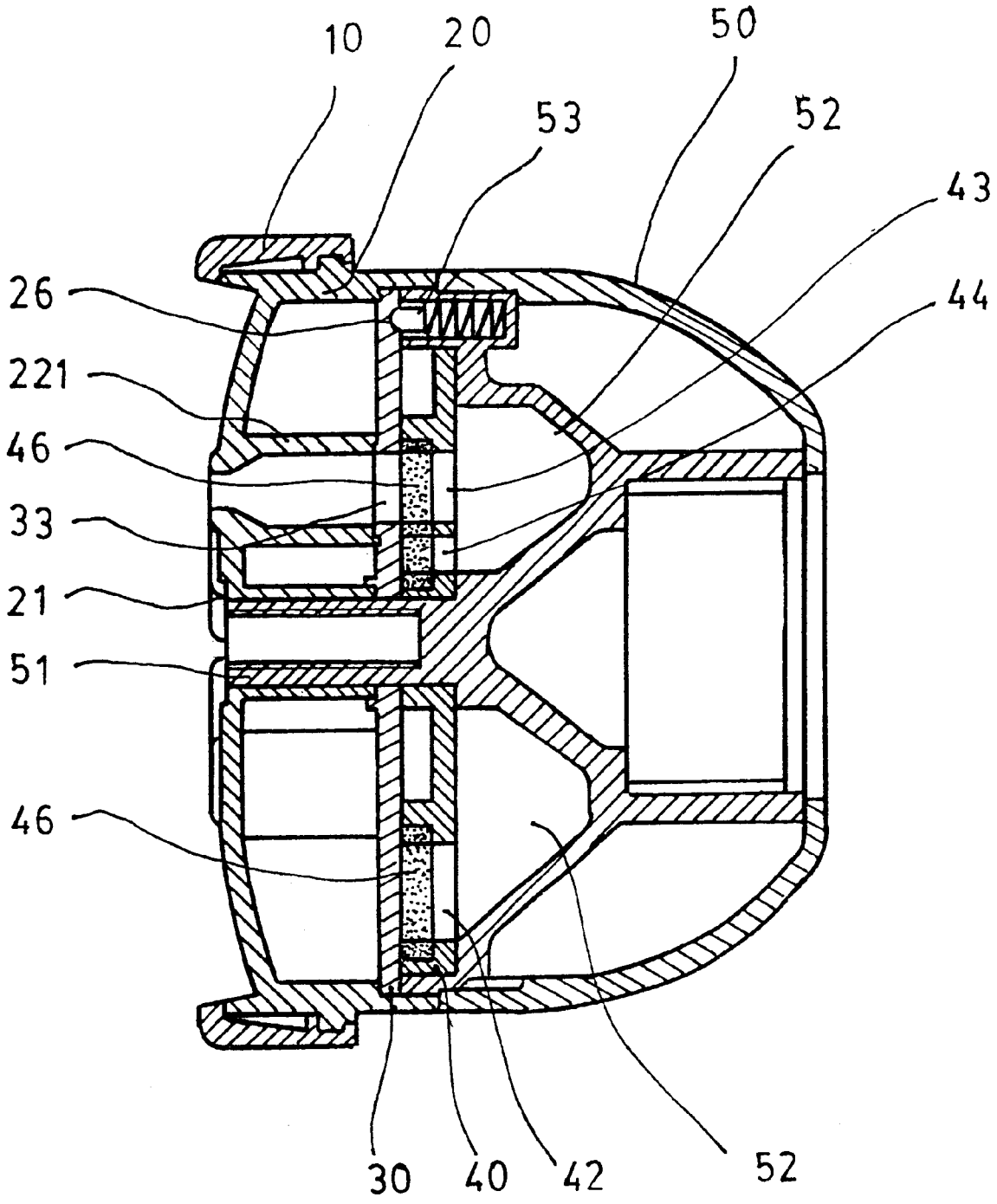
FIG. 9 shows a sectional view of the present invention in combination.

As shown in FIG. 9, the water distribution disk 30 is fastened in the rotary cover 20 by an ultra-sonic technique such that the water emission pillars 221 are inserted into the intermediate water distribution holes 33. The water discharging disk 40 is fastened with the water admission head 50 by the ultra-sonic technique such that the water discharging holes 42, 43 and 44 of the water discharging disk 40 are located at the outside of the water distribution duct 52. The protective cover 10 is joined with the rotary cover 20. A screw is receiver in the axial hole 21 to force an O-ring 46 in the hollow protrusion 45 to press against the water distribution disk 30 so as to prevent the water leak. The head 50 is provided with a locating pillar 53, which is received in the locating slot 36 of the water distribution disk 30.

Figure 10:
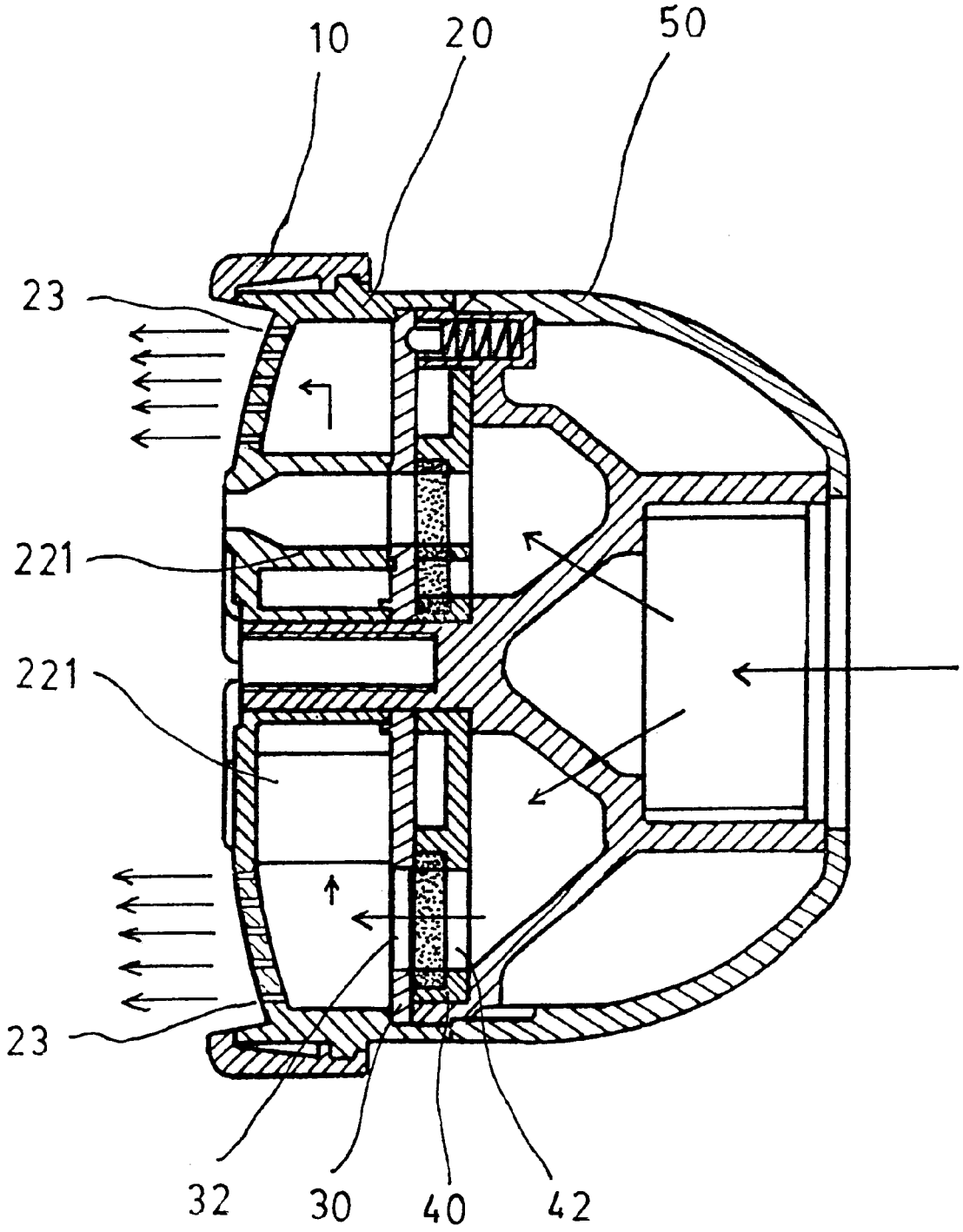
FIG. 10 shows a schematic view of a water passage of the present invention.
Figure 11:
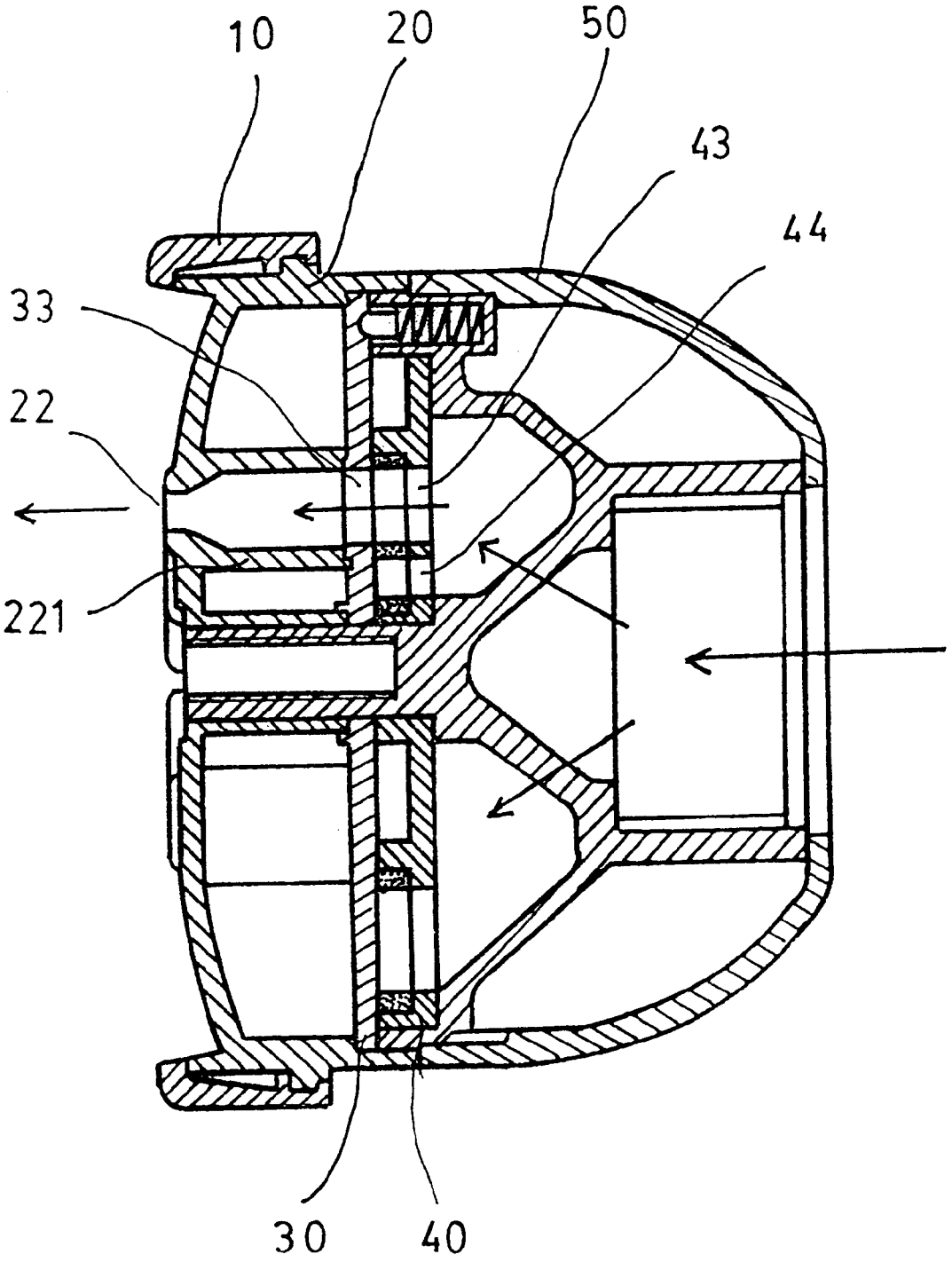
FIG. 11 shows a schematic view of another water passage of the present invention.
Figure 12:
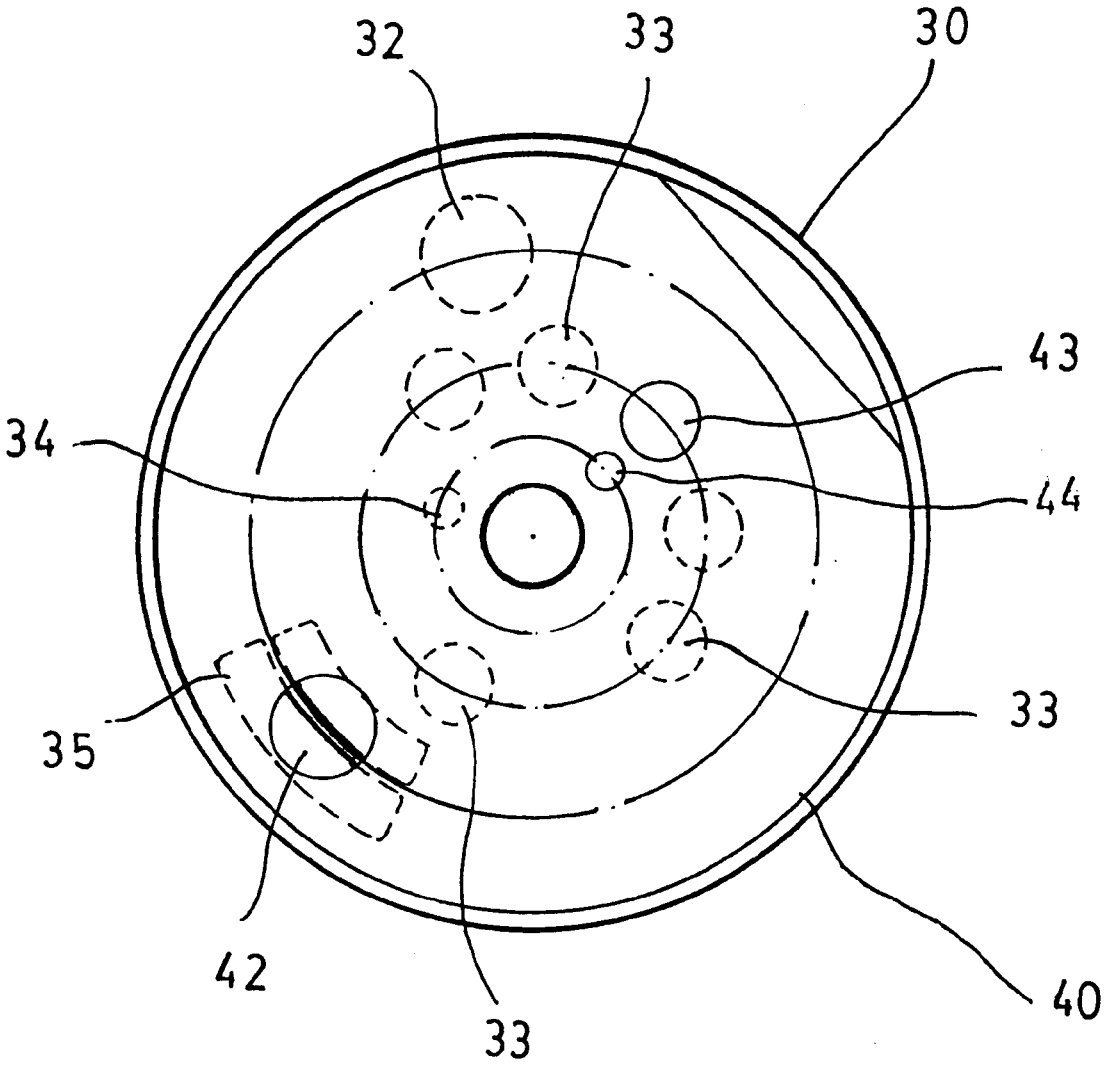
FIG. 12 shows a schematic view of a water slot and a large water outlet opposite to the water slot of the present invention.

As shown in FIGS. 10 and 11, the rotary cover 20 is rotated such that a water emission hole 22 of a desired shape is attained, When the rotary cover 20 is turned such that the large water distribution hole 32 of the water distribution disk 30 is aligned with the large water discharging hole 42 of the water discharging disk 40, the water current is guided into the external space of the water emission pillars 221 such that the water is emitted via the meshes 23. As the rotary cover 20 is turned again such that the intermediate water distribution hole 33 is aligned with the intermediate water discharging hloe 43 of the water discharging disk 40, the water current is guided into the water emission pillars 221 such that the water is emitted via the water emission holes 22. Once again, the rotary cover 20 is turned such that the small water distribution hole 34 is aligned with the small water discharging hole 44 of the water discharging disk 40, thereby enabling the water current to enter the closed space formed by the rib wall 223 and the water emission pillars 221 before the water current is guided into the water emission pillars 221 via the notch 222. The water is thus emitted at the same time via the three water emission pillars 221. The rotary disk 20 is further turned such that the water slot 35 of the water distribution disk 30 is aligned with the large water discharging hole 42 of the water discharging disk 40, the water current enters the water slot 35 before entering the space located the protrusions 45, as shown in FIG. 12. As a result, the water is emitted at the same time via the large water distribution hole 32, the intermediate water distribution hole 33, and the small water distribution hole 34.

In light of the water distribution disk being provided with three water distribution holes of different sizes, the water is emitted in various figures and amounts. In addition, the holes of the water distribution disk and the water discharging disk of the present invention are concentric, the water is emitted with precision in a desired manner. In addition, the present invention is provided with the water slot enabling the water to be distributed swiftly on the water distribution disk, thereby enabling the present invention to emit water stably in a desired amount.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A water nozzle comprising:

a protective cover;

a multi-stepped rotary cover joined with said protective cover and actuated to turn by said protective cover, said rotary cover provided with an axial hole, and a plurality of water emission holes and meshes;

a water distribution disk provided with a center hole, and a plurality of locating slots which are equidistantly arranged along the peripheral edge thereof;

a water discharging disk provided with a center hole; and a water admission head fastened with the barrel of a pistol nozzle and provided with a shaft rod having a water distribution duct;

wherein said rotary cover is provided in said water emission holes with a hollow water emission pillar, a notch disposed at the front end of three water emission pillars adjacent to one another, and a rib wall disposed between two water emission pillars such that said rib wall and said water emission pillars form together a closed space;

wherein said water distribution disk is provided with a large water distribution hole, a small water distribution hole, and a plurality of intermediate water distribution holes corresponding in location to said water emission holes of said rotary cover, said water distribution disk further provided with a water slot concentric with said large water distribution hole;

wherein said water discharging disk is provided with a large water discharging hole, an intermediate water discharging hole, and a small water discharging hole, which are respectively concentric with said large water distribution hole, said intermediate water distribution hole, said small water distribution hole whereby said center hole, said large water discharging hole, said intermediate water discharging hole, and said small water discharging hole of said water discharging disk is provided with a hollow protrusion circumventing the respective hole.

2. The water nozzle as defined in claim 1, wherein said water slot of said water distribution disk is of an arcuate construction whereby said water slot has a mouth with a length greater than the diameter of said protrusion circumventing said large water discharging hole of said water discharging disk.

3. The water nozzle as defined in claim 1, wherein said hollow protrusions of said large water discharging hole, said intermediate water discharging hole, and said small water discharging hole of said water discharging disk are provided with a leakproof O-ring.

* * * * *